US006880972B2

(12) United States Patent
Plourde

(10) Patent No.: US 6,880,972 B2
(45) Date of Patent: Apr. 19, 2005

(54) SLIDER-OPERATED ZIPPER THAT SEPARATES IN VERTICAL PLANE OF RECLOSABLE PACKAGE

(75) Inventor: Eric Paul Plourde, Homewood, IL (US)

(73) Assignee: Illinois Tool Works Inc., Glenview, IL (US)

( * ) Notice: Subject to any disclaimer, the term of this patent is extended or adjusted under 35 U.S.C. 154(b) by 198 days.

(21) Appl. No.: 10/164,526

(22) Filed: Jun. 7, 2002

(65) Prior Publication Data

US 2003/0228074 A1 Dec. 11, 2003

(51) Int. Cl.[7] ..... B65D 33/16
(52) U.S. Cl. ..... 383/64; 24/399
(58) Field of Search ..... 383/64; 24/399, 24/400

(56) References Cited

U.S. PATENT DOCUMENTS 5,809,621 A 9/1998 McCree et al.
5,947,603 A 9/1999 Tilman
6,047,450 A 4/2000 Machacek et al.
6,402,375 B1 * 6/2002 Schreiter et al. ..... 383/64
6,571,430 B1 * 6/2003 Savicki et al. ..... 24/30.5 R
6,581,249 B1 * 6/2003 Savicki et al. ..... 24/30.5 R
6,581,253 B1 * 6/2003 ErkenBrack ..... 24/428

FOREIGN PATENT DOCUMENTS

WO WO 02/21959 A 3/2002
WO WO 02/47986 A 6/2002

* cited by examiner

*Primary Examiner*—Jes F. Pascua
(74) *Attorney, Agent, or Firm*—Ostrager Chong Flaherty & Broitman P.C.

(57) ABSTRACT

A slider-zipper assembly for reclosable packaging in which separation of the zipper halves occurs in the vertical plane. The package comprises front and rear walls disposed on opposing sides of a vertical plane; first and second zipper parts respectively joined to the first and second walls; and a slider for displacing the first zipper part relative to the second zipper part in a downward direction parallel to the vertical plane. In one embodiment, the slider comprises a top wall, first and second side walls connected to the top wall, and an inclined projection projecting from an inner surface of the second side wall. The projection engages a groove in the vertically displaceable zipper part. The end of the projection nearest to the closing end of the slider is located closer to the top wall than is the other end of the projection. In another embodiment, a projection can be formed on the zipper part that engages an inclined groove formed in the slider.

18 Claims, 7 Drawing Sheets

SLIDER-OPERATED ZIPPER THAT SEPARATES IN VERTICAL PLANE OF RECLOSABLE PACKAGE

BACKGROUND OF THE INVENTION

This invention generally relates to slider-operated flexible zippers for use in reclosable pouches, bags or other packages of the type in which perishable material, such as foodstuff, may be stored.

Reclosable fastener assemblies are useful for sealing thermoplastic pouches or bags. Such fastener assemblies often include a plastic zipper and a slider. Typically, the plastic zippers include a pair of interlockable fastener elements, or profiles, that form a closure. As the slider moves across the profiles, the profiles are opened or closed. The profiles in plastic zippers can take on various configurations, e.g. interlocking rib and groove elements having so-called male and female profiles, interlocking alternating hook-shaped closure elements, etc.

Conventional slider-operated zipper assemblies typically comprise a plastic zipper having two interlocking profiles and a slider for opening and closing the zipper. In one type of slider-operated zipper assembly, the slider straddles the zipper and has a separating finger at one end that is inserted between the profiles to force them apart as the slider is moved along the zipper in an opening direction. The other end of the slider is sufficiently narrow to force the profiles into engagement and close the zipper when the slider is moved along the zipper in a closing direction.

Other types of slider-operated zipper assemblies avoid the use of a separating finger. For example, U.S. Pat. No. 5,809,621 discloses a slider-operated zipper assembly wherein one zipper profile has a pair of handles that cooperate with the slider. As the slider is moved in an opening direction, the handles are squeezed together to disengage the profiles. In U.S. Pat. No. 5,442,838, a slider-operated zipper assembly is disclosed wherein the zipper profiles are engaged and disengaged in the course of a "rolling action". This "rolling action" is described as being achieved through cooperation between flanges on the profiles and shoulders which project inwardly from the arms of the slider. U.S. Pat. No. 6,047,450 discloses a zipper comprising a pair of mutually interlockable profiled structures. The first profiled structure comprises an interlocking element on a surface directed toward the second profiled structure and an integral base directed away from the second profiled structure. Likewise, the second profiled structure comprises an interlocking element on a surface directed toward the first profiled structure and an integral base directed away from the first profiled structure. Additionally, portions of the two profiled structures form a fulcrum about which the profiled structures may be pivoted out of engagement when lower edges of the bases are forced towards each other.

In the case of sliders having a separating finger or post, it is usually necessary to have the finger or post extend into the product side of the package. Since the zipper halves are relatively rigid, they do not conform to the shape of the post and a gap is left between the post and the point where the zipper halves are fully mated. This gap creates a potential for liquid and gas leakage from or into the package. From this standpoint, sliders without separating fingers or posts are an improvement.

BRIEF DESCRIPTION OF THE INVENTION

One aspect of the invention is a package comprising: front and rear walls disposed on opposing sides of a vertical plane; first and second zipper parts respectively joined to the first and second walls; and means for displacing the first zipper part relative to the second zipper part in a downward direction parallel to the vertical plane.

Another aspect of the invention is a package comprising a receptacle, a flexible zipper joined to the receptacle, and a slider mounted to the zipper. The zipper comprises a first zipper part comprising a first interlockable element and a second zipper part comprising a second interlockable element. The first and second interlockable elements are mutually interlocked as the slider is moved along the zipper in a first direction to close a mouth in a top of the receptacle and are mutually disengaged as the slider is moved along the zipper in a second direction opposite to the first direction to open the mouth. The slider comprises a top wall and first and second side walls connected to the top wall, an opening end, and a closing end. The second zipper part passes between the first and second side walls and under the top wall of the slider. A section of the first zipper part moves vertically downward, away from the top wall of the slider and out of engagement with an opposing section of the second zipper part, during slider movement in the second direction, and moves vertically upward during slider movement in the first direction.

A further aspect of the invention is an assembly comprising a zipper and a slider mounted to the zipper, wherein the zipper comprises first and second zipper parts that are mutually interlockable, and the slider comprises a top wall generally perpendicular to a vertical direction, first and second side walls connected to the top wall, and a mechanism for vertically displacing the first zipper part relative to the second zipper part. The first and second zipper parts are mutually interlocked as the slider is moved along the second zipper part in a first direction and mutually disengaged as the slider is moved along the second zipper part in a second direction opposite to the first direction.

Another aspect of the invention is a slider for operating a flexible zipper, comprising a top wall, a first side wall connected to the top wall, a second side wall connected to the top wall and generally facing the first side wall, and a camming surface formed adjacent an interior surface of the second side wall. The second side wall extends from an opening end to a closing end of the slider. The camming surface comprises a first end located closer to the closing end than to the opening end and a second end located closer to the opening end than to the closing end, the first end being located closer to the top wall than is the second end. The camming surface may comprise a side surface on a projection or a side surface of a groove formed in the second side wall.

Yet another aspect of the invention is a slider for operating a flexible zipper, comprising a top wall, a first side wall connected to the top wall, a second side wall connected to the top wall and generally facing the first side wall, and a projection projecting from an inner surface of the second side wall. The second side wall extends from an opening end to a closing end of the slider, and the projection comprises first and second side surfaces that extend from said first end to said second end of said projection. The first side surface is separated from said top wall by a distance that is substantially constant in a longitudinal direction, while the second side surface is inclined relative to the top wall. A portion of the second side surface at the first end of the projection is located closer to the top wall than is a portion of the second side surface at the second end of the projection.

One further aspect of the invention is a slider for operating a flexible zipper, comprising a top wall, a first side wall connected to the top wall, a second side wall connected to the top wall and generally facing the first side wall, and first and second pins projecting from an inner surface of the second side wall. The second side wall again extends from an opening end to a closing end of the slider. The first pin is located closer to the closing end than to the opening end, the second pin is located closer to the opening end than to the closing end, and the first pin is located closer to the top wall than is the second pin.

Other aspects of the invention are disclosed and claimed below.

BRIEF DESCRIPTION OF THE DRAWINGS

FIG. 2 shows a section through a portion of the slider adjacent the closing end of the slider, with the zipper closed. FIG. 3 shows a section through a portion of the slider adjacent the opening end of the slider, with the zipper open. [To facilitate the reader's understanding, structure that would ordinarily be visible behind the plane of sectioning has not been shown. This is also true for FIGS. 5 and 6.]

FIG. 5 shows a section through a portion of the slider adjacent the closing end of the slider, with the zipper closed. FIG. 6 shows a section through a portion of the slider adjacent the opening end of the slider, with the zipper open.

FIG. 7 shows a section through a portion of the slider adjacent the closing end of the slider, with the zipper closed. FIG. 8 shows a section through a portion of the slider adjacent the opening end of the slider, with the zipper open.

DETAILED DESCRIPTION OF THE INVENTION

Figure 1:
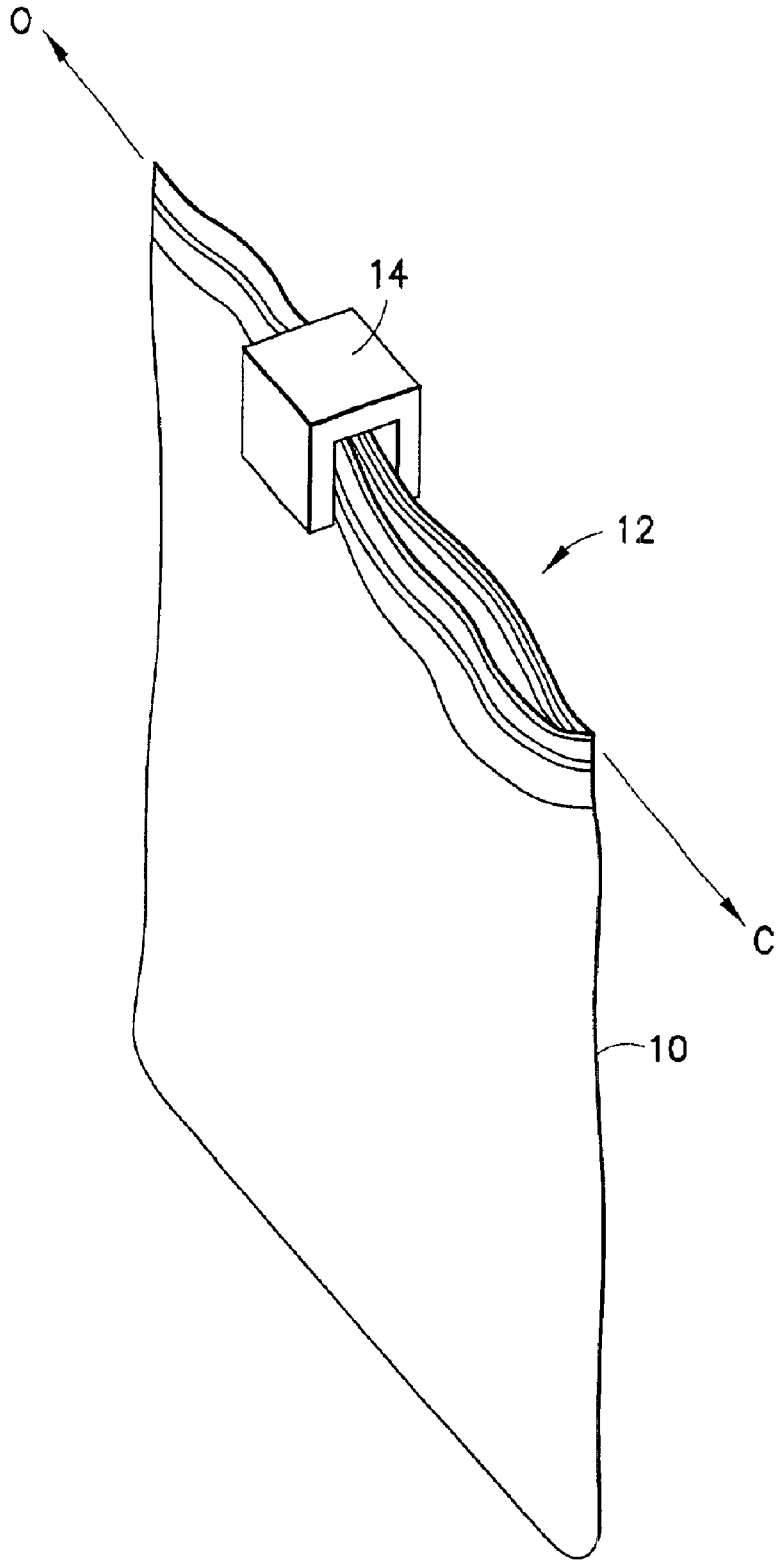
FIG. 1 PRIOR ART
FIG. 1 is a schematic showing an isometric view of a typical reclosable package having a slider-operated flexible zipper.

Reference will now be made to the drawings, in which similar elements in different drawings bear the same reference numerals. A conventional reclosable bag 10 having a flexible plastic zipper 12 operated by manipulation of a slider 14 is shown in FIG. 1. It should be understood that the slider-zipper assemblies disclosed herein can be installed in a reclosable bag of the type shown in FIG. 1 or other types of reclosable packages having different structures.

Still referring to FIG. 1, the bag 10 may be made from any suitable sheet material or plastic film and comprises opposite wall panels, which may be secured together at opposite side edges of the bag by seams (not shown). The opposing bottoms of the wall panels may be joined, for example, by means of a heat seal made in conventional fashion, e.g., by application of heat and pressure or ultrasonic energy. Typically, however, the bottom of the package is formed by a fold in the original packaging film. Optionally, the bag may be provided with side gussets having respective junctures with the front and rear wall panels. In the latter case, the bag may also be provided with a bottom panel having respective junctures with the front and rear wall panels and with the side gussets.

At its top end, the bag 10 has an openable mouth, on the inside of which is an extruded plastic zipper 12. The zipper 12 comprises a pair of interlockable fastener strips or zipper halves. The profiles of the zipper halves may take any form. For example, the zipper may comprise interlocking rib and groove elements or alternating hook-shaped closure elements. The preferred zipper material is polyethylene.

The front and rear bag wall panels are respectively sealed to the zipper halves by heat fusion or welding. Alternatively, the interlockable zipper halves can be attached to the wall panels by adhesive or bonding strips or the zipper profiles can be extruded integrally with the bag material. For the purpose of joinder, each zipper half may be provided with a respective extension flange, to which an upper portion of the respective bag wall panel is fused or welded. The walls of the bag may be formed of various types of thermoplastic material, such as low-density polyethylene, substantially linear copolymers of ethylene and a C3–C8 alpha-olefin, polypropylene, polyvinylidene chloride, mixtures of two or more of these polymers, or mixtures of one of these polymers with another thermoplastic polymer. The person skilled in the art will recognize that this list of suitable materials is not exhaustive.

In zippered bags with sliders, as the slider moves across the zipper, the zipper is opened or closed. As shown in FIG. 1, the slider is slidable along the zipper in a closing direction "C", causing the zipper halves to become engaged, or in an opening direction "O", causing the zipper halves to become disengaged.

The slider for opening or closing the reclosable zipper is generally shaped so that the slider straddles the zipper profiles. The ends of the slider are open to allow the zipper to pass through. The slider may be made in multiple parts and welded together or the parts may be constructed to be snapped together. The slider may also be of one-piece construction. The slider can be made using any desired method, such as injection molding. The slider can be molded from any suitable plastic, such as nylon, polypropylene, polystyrene, acetal, polyketone, polybutylene terephthalate, high-density polyethylene, polycarbonate, or ABS.

A bag incorporating a zipper and a slider preferably includes means, such as end stops (not shown in FIG. 1), for preventing the slider from sliding off the end of the zipper when the slider reaches the closed or fully opened position. Such end stops perform dual functions, serving as stops to prevent the slider from going off the end of the zipper and also holding the two zipper profiles together to prevent the bag from opening in response to stresses applied to the profiles through normal use of the bag. The end stops may, for example, comprise stomped areas on the zipper profiles themselves, riveted end clamps, plastic end clips fused to the zipper, or any other suitable structure. The stomped end stops can be sections of the profiles that are fused together proximate to the open and closed slider positions such that the end stops are raised. Stomping can be carried out by, for example, applying heat and/or pressure or using ultrasonic methods.

The zipper halves preferably comprise interlocking rib and groove elements, which are well known in the art. Many configurations of rib and groove elements may be employed to perform any one of a number of required functions. For instance, specific rib and groove elements may be employed to permit the package to be more easily opened from the outside than from the inside, so that the tension produced by the contents of the package will not accidentally open the rib and groove elements. The rib and groove elements may be carefully formed of a soft flexible material in part thereof so that the contents of the package are in fact relatively hermetically sealed from the outside.

Figure 3:
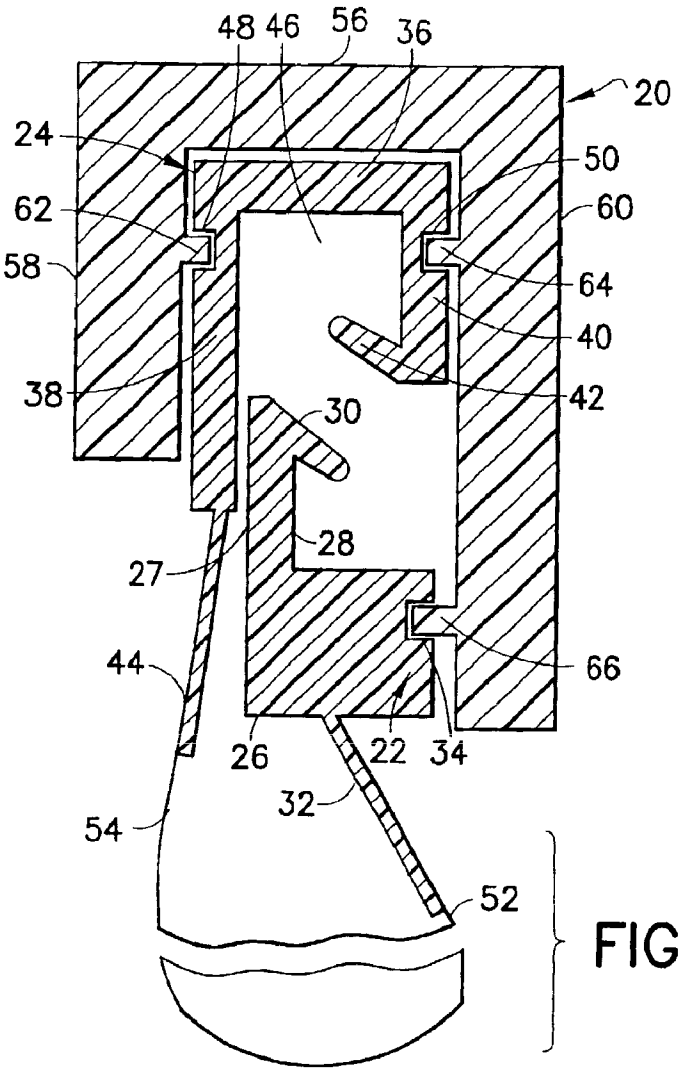
FIGS. 2 and 3 are schematics showing sectional views of a slider-zipper assembly in accordance with one embodiment of the invention. The sections are taken in planes perpendicular to the longitudinal axis of the zipper.
Figure 2:
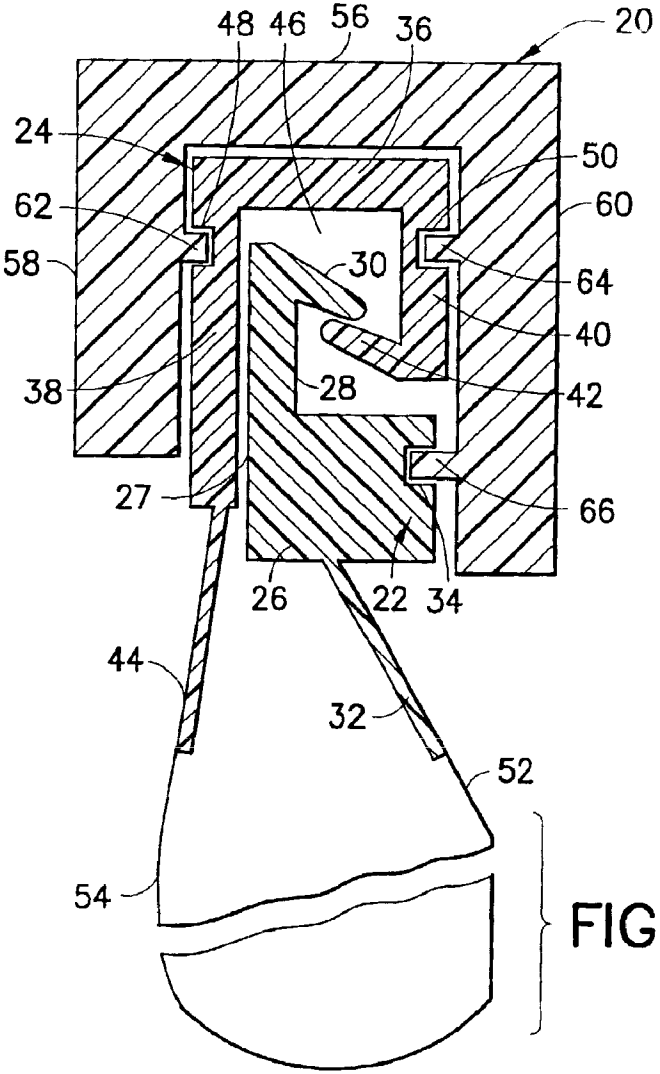

FIGS. 2 and 3 show cross-sectional views of a slider-zipper assembly in accordance with one embodiment of the present invention. The closing end of a slider 20 is shown in FIG. 2; the opening end of the slider 20 is shown in FIG. 3. The zipper is shown in FIG. 2 in a closed state with zipper halves interlocked; the zipper is shown in FIG. 3 in an opened state with the zipper halves disengaged. The zipper comprises first and second fastener strips or zipper parts 22 and 24. Each zipper part is preferably made by extruding thermoplastic material to form a strip with a constant profile.

The first zipper part 22 comprises a base 26, a stem 28 connected to the base 26, a detent 30 connected to the stem 28, and an extension flange 32 connected to the base 26. The stem 28 and detent 30 form a hook. The hook and the extension flange 32 extend on opposite sides of the base 26. It should be appreciated that FIG. 2 shows only the profile of zipper part 22 and that the part extends into and out of the page. The base 26 has a longitudinal groove 34 formed on a side thereof (which groove also extends into and out of the page), facing outward on the side surface. An upper section of a rear bag wall panel 52 is joined to the extension flange 32 by any conventional means.

The second zipper part 24 comprises a top wall 36, a first side wall 38 connected to one end of the top wall 36, a second side wall 40 connected to the other end of the top wall 36, a detent 42 connected to a distal portion of the second side wall 40, and an extension flange 44 connected to a distal portion of the first side wall 38. The side walls 38 and 40 are mutually opposed and may be generally parallel to each other and generally perpendicular to the top wall 36. However, mutual parallelism of the side walls 38 and 40 is not necessary. For example, the second zipper part could be A-shaped, with the first zipper part shaped accordingly.

The first side wall 38 of the second zipper part 24 has a longitudinal groove 48 that faces outward on its exterior surface (which groove extends into and out of the page). The second side wall 40 has a longitudinal groove 50 that faces outward on its exterior surface (which groove extends into and out of the page). An upper section of a front bag wall panel 54 is joined to the extension flange 44 by any conventional means. The front and rear bag wall panels 52 and 54 may be connected at the bag bottom by a fold, as shown in FIG. 2, or by a lap seal, a bottom panel, or a gusset (not shown), or by any other conventional bag structure.

The walls 36, 38 and 40 of zipper part 24 define a longitudinal channel 46 that receives the head of the zipper part 22, i.e., the detent 30, when the depicted sections of the zipper parts are interlocked, i.e., when the depicted zipper section is closed, as shown in FIG. 2. As seen in FIG. 3, the zipper part 22 is displaced vertically downward relative to the zipper part 24 to an extent that causes the zipper parts to disengage. When the zipper parts along a particular zipper section are disengaged, i.e., when the detent 30 has been removed from the channel 46, this section of the zipper is open.

Opening and closing of the zipper is performed by manipulation of a slider 20. The sliders of the embodiments disclosed herein are designed to cause the zipper part 22 to displace vertically relative to the zipper part 24. As used herein, the term "vertical" refers to a direction that is generally perpendicular to a top wall 56 of the slider (remembering again that the top wall extends into and out of the plane of the sectional view shown in FIGS. 2 and 3. The slider 20 further comprises a first side wall 58 connected to one end of the top wall 56 and a second side wall 60 connected to the other end of the top wall 56. The side walls 58 and 60 are mutually opposed and may be generally parallel to each other and generally perpendicular to the top wall 56. However, mutual parallelism of the slider side walls is not necessary. For example, if the zipper has an A-shape, then the slider profile would also be A-shaped.

The first side wall 58 of the slider 20 has a longitudinal projection 62 that is received in groove 48 in the zipper part 24, while the second side wall 60 has a longitudinal projection 64 that is received in groove 50 in the zipper part 24. The projections 62 and 64 are mutually parallel and slide along grooves 48 and 50 during sliding movement of the slider 20 in either the opening or the closing direction. Thus, the slider 20 rides on and is supported by, i.e., is slidably mounted to, the second or outer zipper part 24. The zipper part 24 does not displace vertically relative to the slider 20 during slider movement.

In contrast, the first or inner zipper part 22 displaces vertically relative to the slider 20 during slider movement. During slider movement in the opening direction, the zipper part 22 displaces from the position shown in FIG. 2 to the position shown in FIG. 3. Conversely, during slider movement in the closing direction, the zipper part 22 displaces from the position shown in FIG. 3 to the position shown in FIG. 2. These vertical displacements are caused by camming means, incorporated in the slider 20, which engage the base 26 of the first zipper part 22 and cam the latter vertically upward or downward, depending upon the direction of slider movement.

In accordance with the embodiment of the invention depicted in FIGS. 2 and 3, the slider has a projection 66 that projects from an inner surface of the second side wall 60. The second side wall extends from an opening end to a closing end of the slider. The projection 66 comprises a first end portion located closer to the closing end than to the opening end and a second end portion located closer to the opening end than to the closing end. The first end portion of the projection 66 is depicted in the sectional view shown in FIG. 2, the section being taken near the closing end of the slider. The second end portion of the projection 66 is depicted in the sectional view shown in FIG. 3, the section being taken near the opening end of the slider. As can be seen, the projection end near the slider closing end is located closer to the top wall 56 of the slider than is the projection end near the slider opening end. Alternatively, the projection 66 may take the form of two or more rail segments spaced along a line (not shown). In a further alternative, the projection 66 may be slightly curved near the ends and straight in the middle (not shown), so that a section of the first zipper part 22 displaces vertically at a varying rate as the projection slides along the zipper groove. In this example, the rate at which the zipper section displaces vertically gradually increases as the zipper part is cammed by the curved section near the opening end of the slider; is constant when the zipper part is rammed by the straight section intermediate the curved sections; and then gradually decreases as the zipper part is cammed by the curved section near the closing end of the slider.

Figure 4:
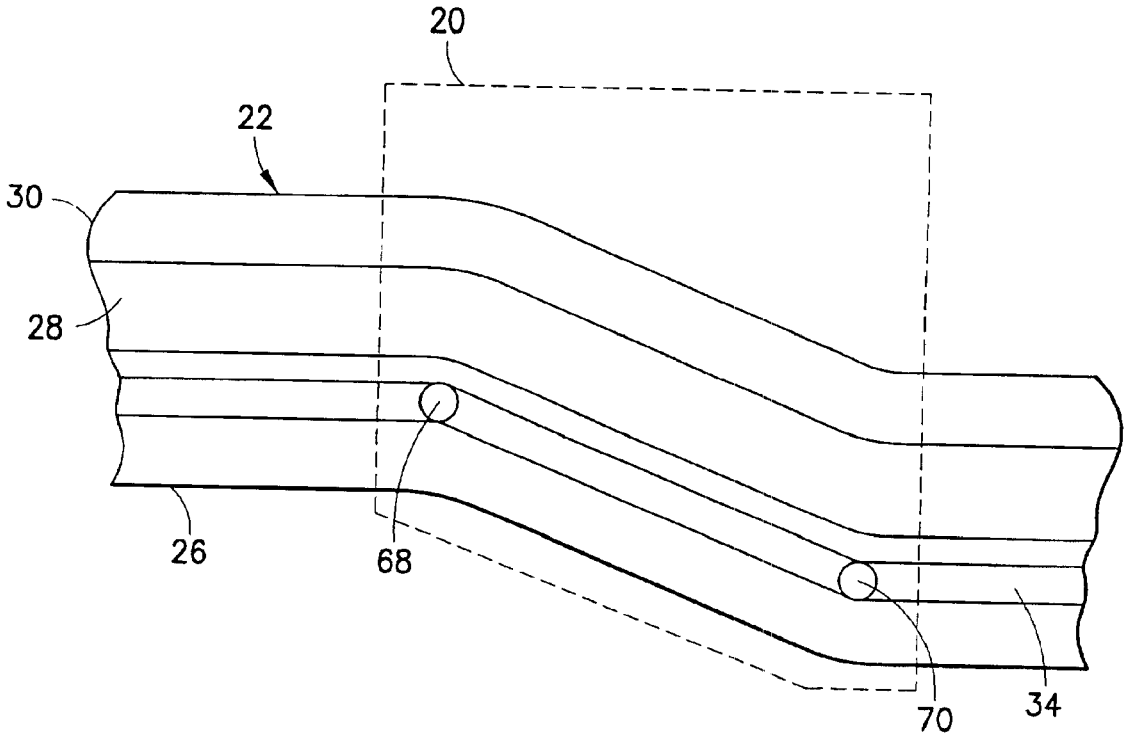
FIG. 4 is a schematic showing a side elevational view of the zipper part that is vertically displaced by the slider in accordance with another embodiment of the invention. The slider is indicated by dashed lines, except for the camming pins, which are shown in solid lines.

In accordance with another embodiment of the invention, instead of an inclined rail, a pair of pins can be used to cam the first zipper part up or down relative to the slider and the second zipper part. This embodiment is partly depicted in FIG. 4, which shows a section of the first zipper part 22 in solid lines and the slider 20 in dashed lines. The second zipper part is not shown. FIG. 4 also shows the respective locations of a pair of camming pins 68 and 70, which engage the groove 34 formed in the base 26 of the first zipper part 22. The camming pins 68 and 70 would correspond in location to the end portions of the linear projection, i.e., rail, previously described. As seen in FIG. 4, when the slider 20 is moved to the right, the pin 68 will cam the interfering portion of zipper part 22 upward, pushing it into engagement with the second zipper part, i.e., closing that section of the zipper. Conversely, when the slider is moved to the left, the pin 70 will cam the interfering portion of the zipper part 22 downward, pulling it out of engagement with the second zipper part, i.e., opening that section of the zipper.

Although the camming pins 68 and 70 are shown as having circular profiles, other shapes would work just as well. For example, the pins could have elliptical profiles or arc-shaped profiles.

For the purpose of illustration, it should be noted that if the pins 68 and 70 were connected form a single rail, that rail would correspond to the linear projection previously described with reference to FIGS. 2 and 3.

Figure 6:
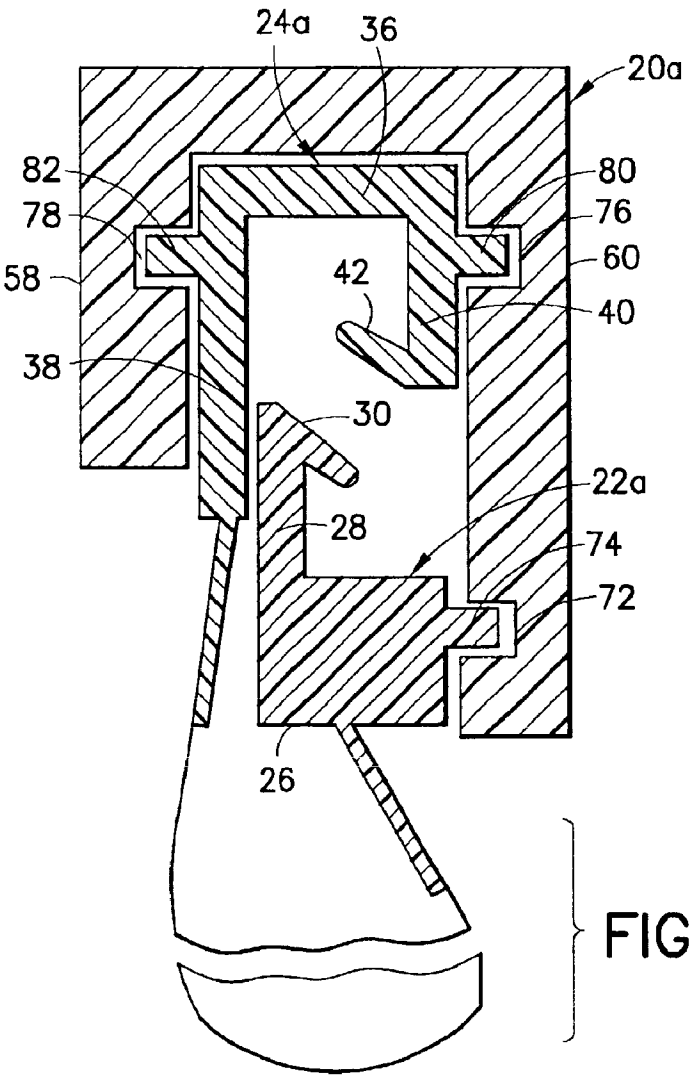
FIGS. 5 and 6 are schematics showing sectional views of a slider-zipper assembly in accordance with a further embodiment of the invention. Again, the sections are taken in planes perpendicular to the longitudinal axis of the zipper.
Figure 5:
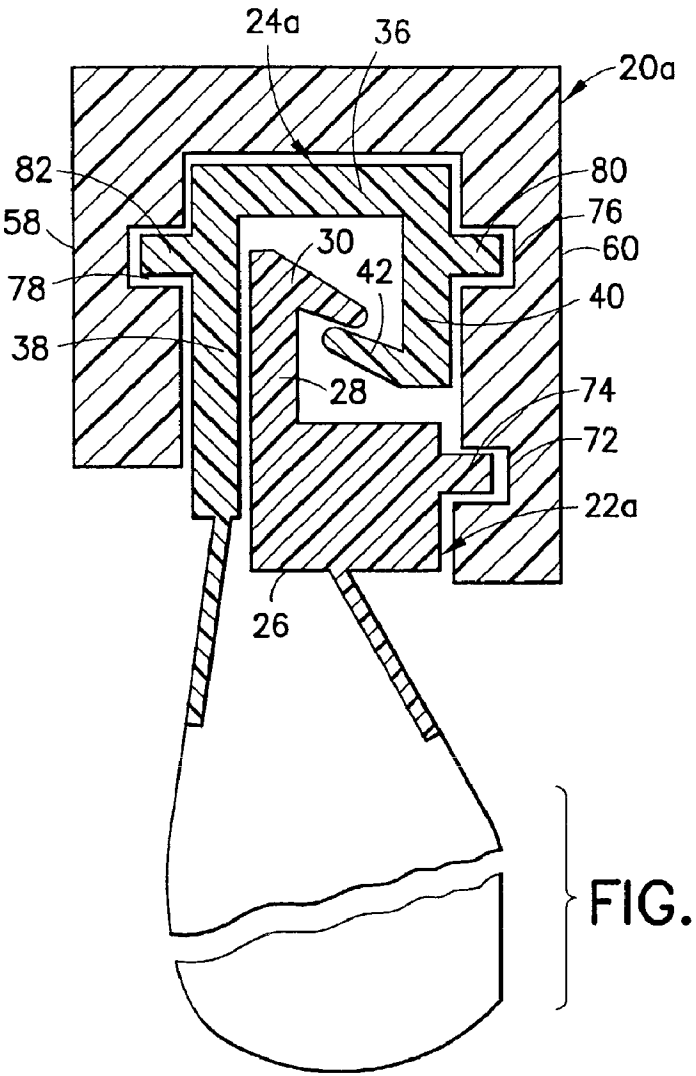

FIGS. 5 and 6 depict another embodiment of the invention. The embodiment depicted in FIGS. 5 and 6 is the same as the embodiment depicted in FIGS. 2 and 3, except that instead of the slider being coupled to the zipper by means of grooves formed in the zipper parts and form-fitting projections formed on the slider, the slider 20*a* is coupled to the zipper by means of grooves formed in the slider and form-fitting projections formed on the zipper parts 22*a*, 24*a*. In this embodiment, the inclined projection is replaced by an inclined linear groove 72 that opens on the interior surface of the second side wall 60 of the slider 20*a*. A longitudinal projection 74 projects from the side of the base 26 of the first zipper part 22*a*. Since the zipper parts are flexible, the first zipper part 22*a* can bend so that projection 74 is maintained in the inclined groove 72 during slider movement. The inclination of the groove 72 causes the first zipper part 22*a* to cam upward or downward depending on the direction of slider movement.

In the embodiment shown in FIGS. 5 and 6, the slider 20*a* rides on longitudinal projections 80 and 82 on the second zipper part 24*a*. These projections, which serve as rails, are mutually parallel and lie in a horizontal plane. The slider 20*a* comprises respective linear grooves 76 and 78 for receiving the projections 80 and 82. Groove 76 is formed in the second side wall 60 and opens at its interior surface, while groove 78 is formed in the first side wall 58 and opens at its interior surface. Each of grooves 72, 76 and 78 extends from the closing end to the opening end of the slider 20*a*.

Figure 10:
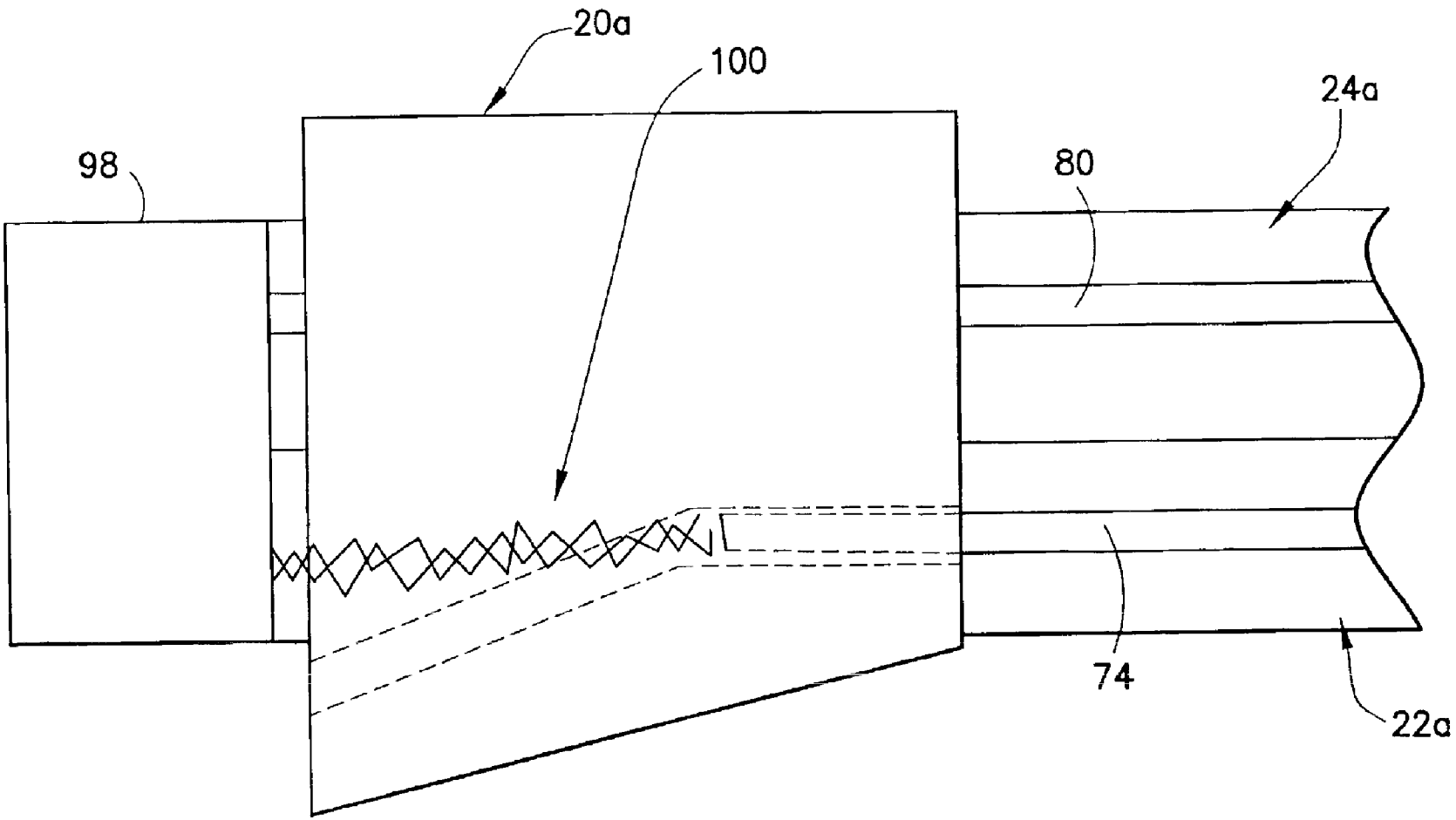
FIG. 10 is a schematic showing a side view of a slider parked at the fully closed position on a flexible zipper of the type shown in FIG. 5, wherein a terminal portion of the projection on the male zipper part has been removed to allow the full length of the zipper to close even when the slider is in the fully closed position.

FIG. 10 is a schematic showing a side view of a slider 20*a* parked adjacent a slider end stop 98 on the flexible zipper depicted in FIG. 5. In conventional manner, slider end stops are formed on both ends of the zipper by crushing or stomping the ends of the zipper parts 22*a* and 24*a* together. The end stops both prevent the slider from sliding off the end of the zipper and join the zipper parts 22*a* and 24*a* at their ends to hold the zipper together. Near the end stop 98, a terminal portion of the projection 74 on the male zipper part 22*a* can be removed (in the area designated 100, which lies behind the slider wall) to allow the full length of the zipper to close even when the slider is in the fully closed position.

Although the disclosed embodiments have all of the grooves on one of the slider and zipper and all of the projections on the other of the slider and zipper, it will be apparent to a person skilled in the art that, for example, the second zipper part could have a projection on one side wall and a groove in the other side wall, while the slider has a matching groove on one side wall and matching projection on the other side wall. Also the slider could be provided with a projection for vertically displacing the first zipper part, and two grooves for riding on rails or projections formed on the second zipper part. All such variations are intended to be within the scope of the present invention.

As should be apparent from FIGS. 2 and 5, in order for the detent 30 to pass detent 42 and enter the channel 46, the detents 30 and 42 must be flexible. As also seen in FIGS. 2 and 5, the side surfaces of the stem 28 and the base 26 of the first zipper part, which confront the side wall 38 of the second zipper part, are coplanar and contiguous, forming a planar side surface 27 that slides against the interior surface of side wall 38 as the first zipper part engages and disengages. This sliding abutment of planar surfaces maintains proper orientation of the first zipper part relative to the second zipper part.

However, the invention is not limited to zipper parts having hook-shaped closure elements, such as those formed by stem 28/detent 30 and side wall 40/detent 42. Alternatively, the first zipper part could comprise a base, a stem connected to the base, and an arrowhead connected to the distal portion of the stem, the arrowhead having detents on opposite sides thereof, while the second zipper part would comprise detents extending inward from both side walls, thereby forming a female profile for receiving the male profile of the first zipper part. Such an embodiment is depicted in FIGS. 7 and 8.

Figure 8:
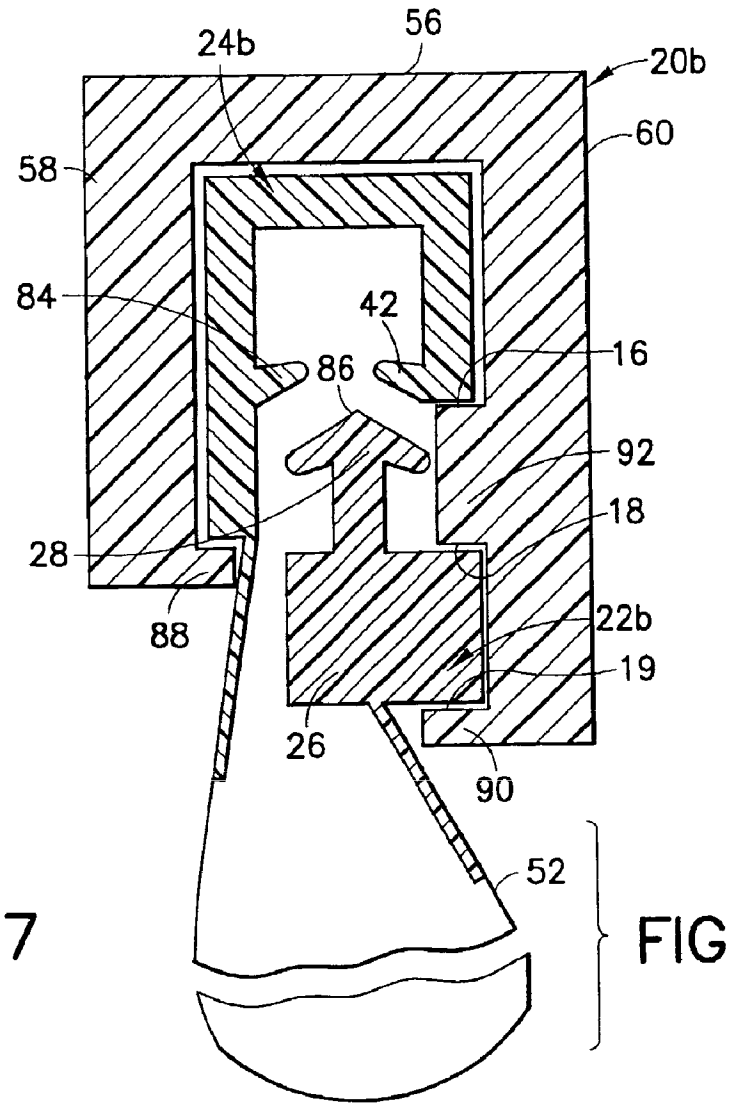
FIGS. 7 and 8 are schematics showing sectional views of a slider-zipper assembly in accordance with yet another embodiment of the invention. Again, the sections are taken in planes perpendicular to the longitudinal axis of the zipper.
Figure 7:
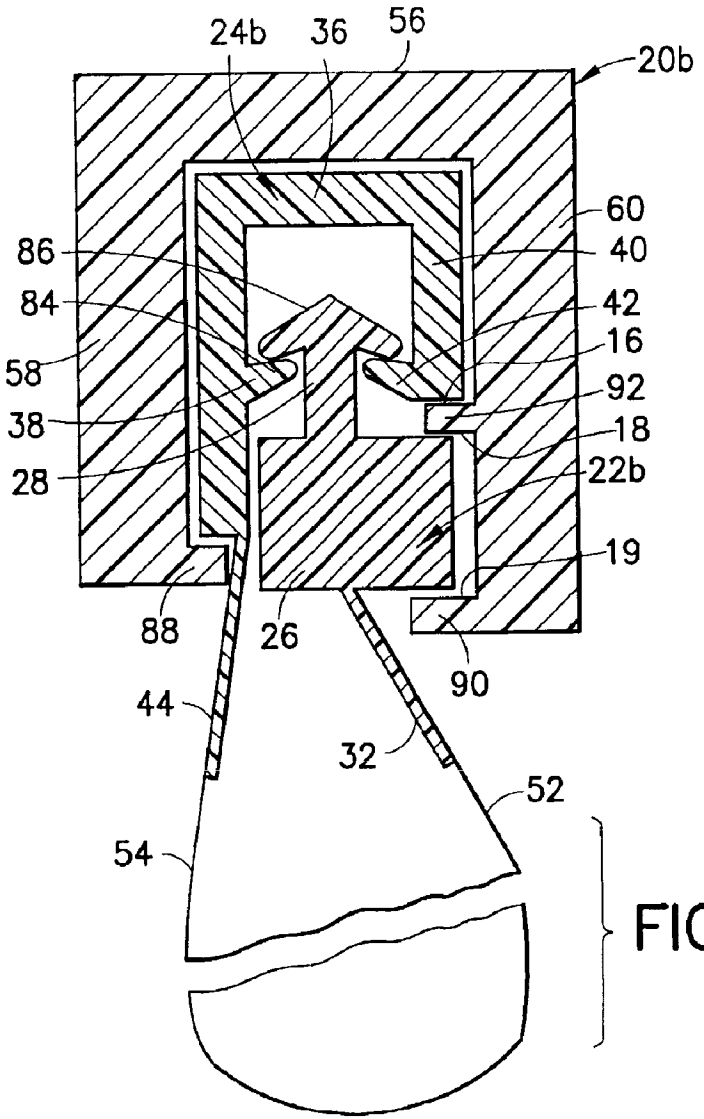

The assembly depicted in FIGS. 7 and 8 comprises a slider 20*b*, a first zipper part 22*b* and a second zipper part 24*b*. Movement of the slider 20*b* along the zipper causes the first zipper part 22*b* to displace vertically relative to the second zipper part 24*b* and relative to the slider. FIG. 7 shows the zipper closed; FIG. 8 shows the zipper open.

The first zipper part 22*b* comprises a base 26, a stem 28 connected to the base 26, an arrow-shaped head 86 connected to the stem 28, and an extension flange 32 connected to the base 26. The stem 28 and head 86 have a male profile that is received in the female profile of the second zipper part 24*b*. The male profile and the extension flange 32 extend on opposite sides of the base 26.

The second zipper part 24*b* comprises a top wall 36, a first side wall 38 connected to one end of the top wall 36, a second side wall 40 connected to the other end of the top wall 36, a detent 42 connected to a distal portion of the second side wall 40, a detent 84 connected to an intermediate portion of the first side wall 38 and directly opposite to detent 42, and an extension flange 44 connected to a distal portion of the first side wall 38. The width of the opening defined by the detents 42 and 84 is less than the width of the arrow-shaped head 86. The outwardly directed detents of head 86 must pass between the detents 42 and 84 in order for the zipper parts to interlock. This is accomplished by flexing of the detents as the head 86 enters and exits the female profile.

In the embodiment depicted in FIGS. 7 and 8, the slider 20*b* comprises a top wall 56, a first side wall 58 connected to one end of the top wall 56, and a second side wall 60 connected to the other end of the top wall 56. The slider 20*b* further comprises a pair of projections 88 and 92 that latch under the ends of the side walls of the second zipper part 24*b*, thereby preventing any substantial vertical displacement of the second zipper part 24*b* relative to the slider 20*b*. Projection 88 is preferably a longitudinal projection of constant width projecting inward from a distal portion of the first side wall 58 of the slider. Projection 92 is preferably a projection projecting inward from an intermediate portion of the second side wall 60 of the slider and having a width that increases linearly from the vicinity of the closing end (seen in FIG. 7) to the vicinity of the opening end (seen in FIG. 8). The upper side surface of projection 92 is separated from the top wall 56 of the slider by a distance that is substantially constant in a longitudinal direction (i.e., into the page of the drawing), while the lower side surface is inclined relative to the top wall. A portion of the lower side surface 18 at the end of projection 92 near the closing end of the slider (seen in FIG. 7) is located closer to the top wall than is a portion of lower side surface 18 at the end of projection 92 near the opening end of the slider (seen in FIG. 8).

In addition, the slider 20*b* comprises a third projection 90 that projects inward from a distal portion of the second side wall 60 of the slider. The projection 90 is inclined and preferably of constant width. Projection 90 comprises a side surface 19 that is preferably parallel to the side surface 18, the two side surfaces forming a wide groove that receives one side of the base 26 of the first zipper part 22*b*. Because parallel surface 18 and 19 are inclined, the groove is likewise inclined. Thus, when the slider 20*b* is moved longitudinally along the second zipper part 24*b* in a closing direction, the camming surface 19 will displace the first zipper part 22*b* upward and into engagement with the second zipper part 24*b*. Conversely, when the slider 20*b* is moved longitudinally along the second zipper part 24*b* in an opening direction, the camming surface 18 will displace the first zipper part 22*b* downward and out of engagement with the second zipper part 24*b*. This configuration of a wide groove in the slider for capturing the base of the first zipper part can be substituted for the arrangement seen in FIG. 5 wherein the base has a projection that fits in a narrow groove formed in the slider.

Figure 9:
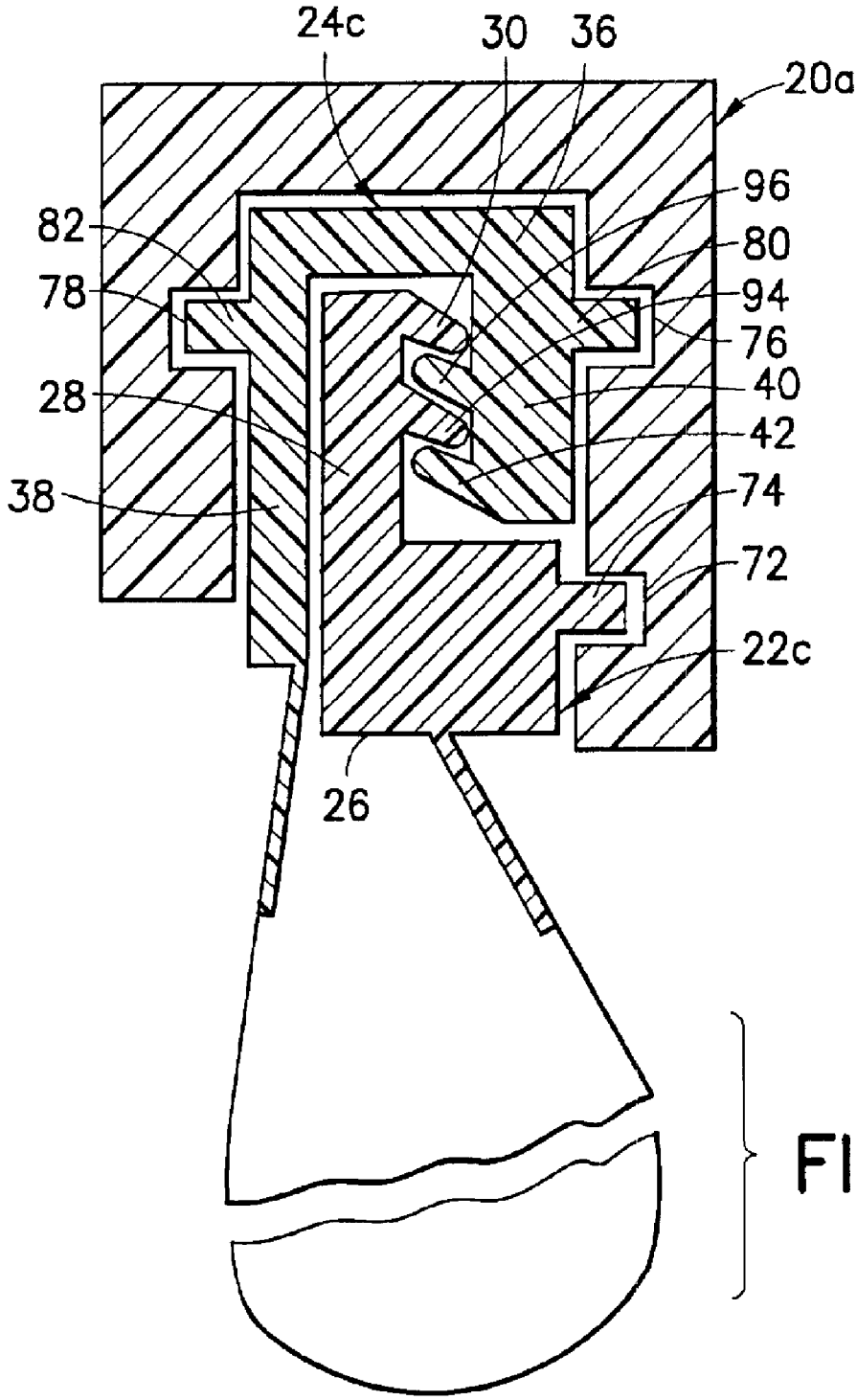
FIG. 9 is a schematic showing a sectional view of another embodiment that is a variant of the embodiment shown in FIG. 5.

In accordance with another embodiment of the invention, instead of the zipper parts 22*c*, 24*c* having hooks with a single detent, each hook may have two detents, as shown in FIG. 9, wherein another detent 94 is connected to an intermediate portion of the stem 28 and another detent 96 is connected to an intermediate portion of the second side wall 40. In the fully engaged state, the detent 94 is interleaved with the detents 42 and 96, while the detent 96 is interleaved between the detents 30 and 94.

In all embodiments disclosed herein, the zipper profiles may be configured and sized with tolerances sufficiently close to ensure a liquid-tight interlock between the profiles.

While the invention has been described with reference to various embodiments, it will be understood by those skilled in the art that various changes may be made and equivalents may be substituted for elements thereof without departing from the scope of the invention. In addition, many modifications may be made to adapt a particular situation to the teachings of the invention without departing from the essential scope thereof. For example, a slider/zipper assembly may be constructed in which the relationship between the slider and the lower half of the zipper remains constant while the top half of the zipper is lifted off the lower half by the slider. Therefore it is intended that the invention not be limited to the particular embodiment disclosed as the best mode contemplated for carrying out this invention, but that the invention will include all embodiments falling within the scope of the appended claims.

As used in the claims, the term "package" means a container, bag, pouch or other receptacle for objects, material or stuff. A container, bag, pouch or other receptacle is deemed to be a package even if not yet packed with objects, material or stuff. As used in the claims, the verb "joined" means fused, bonded, sealed, adhered, etc., whether by application of heat and/or pressure, application of ultrasonic energy, application of a layer of adhesive material or bonding agent, interposition of an adhesive or bonding strip, etc. As used in the claims, the term "projection" means a projection that is continuous or comprises a series of spaced-apart projecting sections.

What is claimed is:

1. A package comprising:

front and rear walls disposed on opposing sides of a vertical plane;

first and second zipper parts respectively joined to said first and second walls;

means for displacing said first zipper part relative to said second zipper part in a direction generally parallel to said vertical plane; and a slider mounted to said second zipper part, wherein said slider comprises a top wall and first and second side walls connected to said top wall, and said displacing means comprise a groove and a projection residing in said groove, one of said groove and said projection forming part of said second side wall of said slider and the other of said groove and said projection forming part of said first zipper part.

2. The package as recited in claim 1, wherein said groove is formed in said second side wall of said slider, said groove being inclined relative to said top wall.

3. The package as recited in claim 1, further comprising first and second grooves that are mutually parallel and first and second projections respectively seated in said first and second grooves, wherein two of said first and second grooves and said first and second projections form part of said slider and the other two of said first and second grooves and said first and second projections form part of said second zipper part.

4. The package as recited in claim 1, wherein said second zipper part comprises a side wall, a top wall connected to said side wall, and a first hook connected to said top wall and facing said side wall, and said first zipper part comprises a base and a second hook connected to said base, said base comprising a portion that engages a portion of said slider, and said second hook being hooked to said first hook when said zipper is closed.

5. The package as recited in claim 4, wherein said base comprises a first planar side surface and said second hook comprises a second planar side surface, said first and second planar side surfaces being coplanar and contiguous.

6. A package comprising a receptacle, a flexible zipper joined to said receptacle, and a slider mounted to said zipper, wherein:

said zipper comprises a first zipper part comprising a first interlockable element and a second zipper part comprising a second interlockable element, said first and second interlockable elements being mutually interlocked as said slider is moved along said zipper in a first direction to close a mouth in a top of said receptacle and being mutually disengaged as said slider is moved along said zipper in a second direction opposite to said first direction to open said mouth; and said slider comprises a top wall and first and second side walls connected to said top wall, an opening end, and a closing end, said second zipper part passing between said first and second side walls and under said top wall of said slider, wherein a section of said first zipper part moves vertically downward, away from said top wall of said slider and out of engagement with an opposing section of said second zipper part, during slider movement in said second direction, and moves vertically upward during slider movement in said first direction, and wherein said first zipper part comprises a projection projecting from one side thereof and extending along a major section of said first zipper part, and said slider comprises a groove that is engaged with said projection of said first zipper part during slider movement along said zipper, said first groove being inclined relative to said top wall of said slider.

7. The package as recited in claim 6, further comprising means for providing that said section of said second zipper part does not move vertically relative to said slider during slider movement along said zipper.

8. The package as recited in claim 6, wherein said second zipper part comprises a top wall and first and second side walls connected to said top wall, said first and second side walls being generally mutually opposed, and said second interlockable element being connected to a distal portion of said second side wall, said first interlockable element of said first zipper part being received between said first and second side walls and behind said second interlockable element when said zipper is closed.

9. The package as recited in claim 8, wherein said first zipper part comprises a base and a rib connected to said base, said base comprising a portion that engages a portion of said slider, and said rib comprising said first interlockable element and a stem, said stem being connected to said base and said first interlockable element being connected to said stem.

10. The package as recited in claim 9, wherein said first zipper part further comprises a first extension flange connected to said base, and said second zipper part comprises a second extension flange connected to said first side wall, said receptacle being joined to said first and second extension flanges.

11. The package as recited in claim 9, wherein each of said first and second interlockable elements comprises a respective detent, said detents being substantially oppositely directed.

12. The package as recited in claim 6, wherein said second zipper part comprises a side wall, a top wall connected to said side wall, and a first hook connected to said top wall and facing said side wall, and said first zipper part comprises a base and a second hook connected to said base, said base comprising a portion that engages a portion of said slider, and said second hook being hooked to said first hook when said zipper is closed.

13. The package as recited in claim 12, wherein said base comprises a first planar side surface and said second hook comprises a second planar side surface, said first and second planar side surfaces being coplanar and contiguous.

14. A package comprising a receptacle, a flexible zipper joined to said receptacle, and a slider mounted to said zipper, wherein:

said zipper comprises a first zipper part comprising a first interlockable element and a second zipper part comprising a second interlockable element, said first and second interlockable elements being mutually interlocked as said slider is moved along said zipper in a first direction to close a mouth in a top of said receptacle and being mutually disengaged as said slider is moved along said zipper in a second direction opposite to said first direction to open said mouth, said slider comprises a top wall and first and second side walls connected to said top wall, an opening end, and a closing end, said second zipper part passing between said first and second side walls and under said top wall of said slider, a section of said first zipper part moves vertically downward, away from said top wall of said slider and out of engagement with an opposing section of said second zipper part, during slider movement in said second direction, and moves vertically upward during slider movement in said first direction, and the package further comprising first and second grooves that are mutually parallel and first and second projections respectively seated in said first and second grooves, wherein two of said first and second grooves and said first and second projections form part of said slider and the other two of said first and second grooves and said first and second projections form part of said second zipper part.

15. An assembly comprising a zipper, a slider mounted to said zipper, said zipper comprising first and second zipper parts that are mutually interlockable, and said slider comprising a top wall generally perpendicular to a vertical direction, first and second side walls connected to said top wall, and a mechanism for vertically displacing said first zipper part relative to said second zipper part, said first and second zipper parts being mutually interlocked as said slider is moved along said second zipper part in a first direction and mutually disengaged as said slider is moved along said second zipper part in a second direction opposite to said first direction, and first and second grooves that are mutually parallel and first and second projections respectively seated in said first and second grooves, wherein two of said first and second grooves and said first and second projections form part of said slider and the other two of said first and second grooves and said first and second projections form part of said second zipper part.

16. The assembly as recited in claim 15, wherein said second zipper part comprises a top wall opposing said top wall of said slider, and first and second side walls connected to said top wall and respectively opposed to said first and second side walls of said slider.

17. The assembly as recited in claim 15, further comprising means for providing that said second zipper part does not move vertically relative to said slider during slider movement along said second zipper part.

18. The assembly as recited in claim 15, wherein said first zipper part comprises a projection projecting from one side thereof and extending along a major section of said first zipper part, and said slider comprises a groove that is engaged with said projection of said first zipper part during slider movement along said second zipper part, said first groove being inclined relative to said top wall of said slider.

* * * * *